US009743810B2

(12) United States Patent
Schultz et al.

(10) Patent No.: US 9,743,810 B2
(45) Date of Patent: Aug. 29, 2017

(54) SHOWER DOOR GUIDE ASSEMBLY

(71) Applicant: LIBERTY HARDWARE MFG. CORP., Winston-Salem, NC (US)

(72) Inventors: Nathaniel Faltin Dutton Schultz, Charlotte, NC (US); James Allen Austin, III, High Point, NC (US); Patrick Boehnen, Summerfield, NC (US)

(73) Assignee: LIBERTY HARDWARE MFG. CORP., Winston-Salem, NC (US)

( * ) Notice: Subject to any disclaimer, the term of this patent is extended or adjusted under 35 U.S.C. 154(b) by 0 days.

(21) Appl. No.: 14/814,921

(22) Filed: Jul. 31, 2015

(65) Prior Publication Data

US 2017/0027388 A1 Feb. 2, 2017

(51) Int. Cl.

| | |
|---|---|
| ***A47K 3/34*** | (2006.01) |
| ***E05D 15/06*** | (2006.01) |
| ***E06B 3/46*** | (2006.01) |

(52) U.S. Cl.

CPC ..... *A47K 3/34* (2013.01); *E05D 15/063* (2013.01); *E05D 15/0621* (2013.01);
(Continued)

(58) Field of Classification Search

CPC .. A47K 3/34; E05D 15/0621; E05D 15/0678; E05D 15/0691
(Continued)

(56) References Cited

U.S. PATENT DOCUMENTS

| | | | |
|---|---|---|---|
| 475,948 | A | 5/1892 | Pease |
| 739,027 | A | 9/1903 | Raum |

(Continued)

FOREIGN PATENT DOCUMENTS

| | | | |
|---|---|---|---|
| CA | 2505163 | A1 | 10/2006 |
| CN | 203175303 | U | 9/2013 |

(Continued)

OTHER PUBLICATIONS www.thermatru.com/trade-professional/dpprgallerdisplays.aspx, "Door Gallery Displays", Jul. 10, 2010, 31 pages.

(Continued)

*Primary Examiner* — Adriana Figueroa
(74) *Attorney, Agent, or Firm* — Brooks Kushman P.C.; Lora Graenzdoerffer

(57) ABSTRACT

A shower door guide assembly is provided with a pair of spaced apart brackets. Each bracket has a receptacle formed therein. A crossbeam is provided with a guide formed therein for cooperation with a roller assembly of a door. The crossbeam has a cross-section sized so that terminal ends of the crossbeam are each received in one the receptacles of the pair of brackets for pivoting about a lengthwise axis of crossbeam and translation in the receptacle during installation of the crossbeam terminal ends into receptacles of the pair of brackets. The receptacles and the crossbeam are sized so that each terminal end of the crossbeam can be received in only one receptacle at only one orientation of the installed crossbeam to prevent improper installation. An alignment configuration extends from each bracket to engage a pair of wall jambs for alignment of the brackets to the wall jambs.

17 Claims, 9 Drawing Sheets

(52) U.S. Cl.
CPC ..... *E05D 15/0626* (2013.01); *E05D 15/0652* (2013.01); *E05D 15/0678* (2013.01); *E05D 15/0691* (2013.01); *E06B 3/4636* (2013.01); *E05Y 2900/114* (2013.01)

(58) Field of Classification Search
USPC ..... 52/207, 656.7; 4/607, 610
See application file for complete search history.

(56) References Cited

U.S. PATENT DOCUMENTS 805,570 A * 11/1905 Maldaner ..... E06B 9/323 182/228.4
865,465 A 9/1907 Williams
949,915 A 2/1910 Schreiber
1,242,872 A 10/1917 Saunders
1,530,211 A 3/1925 Siemnash
1,688,255 A 10/1928 Wasch
1,736,828 A 11/1929 Lobban
1,841,620 A 1/1932 McCoy
1,927,837 A 9/1933 Kingdon
2,113,288 A 4/1938 Berger
2,223,770 A 12/1940 Nagle
D129,731 S 9/1941 Luttrell
2,290,104 A 7/1942 Larson
2,501,609 A 3/1950 Midouhas
D165,358 S 12/1951 Baldwin
2,879,899 A 3/1959 Shenkin
2,884,136 A 4/1959 Leighton
2,937,743 A 5/1960 Buttery et al.
2,944,679 A 7/1960 Rubenstein
2,950,001 A 8/1960 Bucko
3,033,356 A 5/1962 Meyerson
3,121,511 A 2/1964 Whitehead
3,175,694 A 3/1965 Reibold et al.
3,347,357 A 10/1967 De Soto et al.
3,359,573 A 12/1967 Casebolt
3,361,330 A 1/1968 Arneson
3,385,451 A 5/1968 Anderson
D211,321 S 6/1968 Ullmann
3,388,787 A 6/1968 Growney
3,468,593 A 9/1969 Catlett
3,517,459 A 6/1970 Schupper
3,517,801 A 6/1970 Cote
D224,692 S 8/1972 Gray
3,732,633 A 5/1973 Margolis et al.
D227,351 S 6/1973 Winston
3,777,883 A 12/1973 Hackenberg
3,777,896 A 12/1973 Ehrlich
3,889,813 A 6/1975 Wright
3,935,949 A 2/1976 Cohen
D240,503 S 7/1976 Crescenzi et al.
4,105,125 A 8/1978 Magness
4,109,786 A 8/1978 Roccaforte et al.
4,145,849 A 3/1979 Shindoll et al.
4,256,043 A 3/1981 Ovitz, III
D259,161 S 5/1981 Thauer
4,315,569 A 2/1982 Jaeschke
4,342,268 A 8/1982 Grava
4,378,905 A 4/1983 Roccaforte
4,385,687 A 5/1983 Dutcher
4,429,791 A 2/1984 Ruppel et al.
4,634,010 A 1/1987 Otema
4,705,175 A 11/1987 Howard et al.
4,720,876 A 1/1988 Tomei et al.
4,750,609 A 6/1988 Felis
4,762,235 A 8/1988 Howard et al.
5,031,781 A 7/1991 Price et al.
D319,934 S 9/1991 Terrell et al.
D323,986 S 2/1992 Ferrero
5,111,943 A 5/1992 Ramey
D332,744 S 1/1993 McCooey
5,234,113 A 8/1993 Ramey
D343,075 S 1/1994 Cappel, III
5,297,685 A 3/1994 Ramey
5,305,898 A 4/1994 Merl
D349,458 S 8/1994 Verdaguer
5,346,076 A 9/1994 Hart
5,348,167 A 9/1994 Jensen
5,368,486 A 11/1994 Kurzman
5,372,278 A 12/1994 Leight
D355,586 S 2/1995 Wang
5,467,915 A 11/1995 Mattson
5,503,278 A 4/1996 Ishmael
5,509,541 A 4/1996 Merl
D372,816 S 8/1996 Rose et al.
5,547,053 A 8/1996 Liang
D377,144 S 1/1997 Sawa
5,675,936 A 10/1997 Kurth et al.
D392,820 S 3/1998 Shanahan et al.
5,769,247 A 6/1998 Merl
D396,805 S 8/1998 Broyles
5,822,810 A * 10/1998 Chen ..... A47K 3/38 4/607
5,823,339 A 10/1998 Dunham et al.
5,848,446 A 12/1998 DeBraal
5,860,526 A 1/1999 Burke, Jr.
D405,369 S 2/1999 Dohner
5,887,782 A 3/1999 Mueller
D409,858 S 5/1999 Reed
5,941,384 A 8/1999 Schonhardt et al.
D417,978 S 12/1999 Reed
D425,972 S * 5/2000 Smale ..... D23/305
6,102,206 A 8/2000 Pride
6,102,502 A 8/2000 Melillo et al.
6,105,796 A 8/2000 Buchanan et al.
6,170,675 B1 1/2001 Follman et al.
6,182,738 B1 2/2001 Chen
6,250,044 B1 6/2001 Funk et al.
D451,801 S 12/2001 Schillinger
6,340,092 B1 1/2002 McGrath, Jr.
D454,067 S 3/2002 Schoening et al.
6,389,991 B1 5/2002 Morrisson
D461,974 S 8/2002 Hayden
6,461,705 B2 10/2002 Eichhorn
6,467,856 B1 10/2002 Chang et al.
6,484,890 B1 11/2002 Miller
D466,804 S 12/2002 Solland
D469,349 S 1/2003 Meeker et al.
6,594,973 B1 7/2003 Alpert et al.
D482,265 S 11/2003 Wicha
6,672,546 B2 1/2004 Calleja
6,681,445 B2 1/2004 Huang
6,701,672 B2 * 3/2004 Teubert ..... A47K 3/30 4/600
6,811,046 B2 11/2004 Stein
6,850,208 B1 2/2005 Ferrante
6,895,714 B2 5/2005 Teubert et al.
D507,741 S 7/2005 Lu et al.
6,913,151 B2 7/2005 Stevenson
6,935,514 B2 8/2005 Lackey et al.
7,137,172 B2 11/2006 Elmer
7,150,361 B2 12/2006 Calleja
7,178,681 B2 2/2007 Libman
7,264,126 B1 9/2007 Bergeron
7,273,084 B2 * 9/2007 Chen ..... A47K 3/362 160/187
7,334,381 B2 2/2008 Mertz, II et al.
7,346,939 B2 3/2008 Perry
D588,905 S 3/2009 Meeks et al.
D593,409 S 6/2009 Blick
D594,742 S 6/2009 Meier et al.
7,562,949 B1 7/2009 Nielsen
D600,110 S 9/2009 Cain
7,637,059 B2 12/2009 Chang et al.
D607,724 S 1/2010 Dreier et al.
7,748,527 B2 7/2010 Wisecarver et al.
7,762,508 B2 * 7/2010 Xu ..... A47K 3/38 248/251
7,828,151 B2 11/2010 Murdoch et al.
7,841,048 B2 11/2010 Tsai
7,900,784 B1 3/2011 Weigand et al.
D639,652 S 6/2011 Abdalkhani et al.
7,962,998 B2 6/2011 Proctor et al.

(56) References Cited

U.S. PATENT DOCUMENTS

| | | | | |
|---|---|---|---|---|
| D652,717 | S | 1/2012 | Shimoyama et al. | |
| D660,988 | S | 5/2012 | Amend | |
| 8,191,707 | B2 | 6/2012 | McDonald et al. | |
| D668,540 | S | 10/2012 | Lutzig | |
| 8,312,998 | B2 | 11/2012 | Theisen | |
| D685,260 | S | 7/2013 | Thielemier | |
| 8,490,331 | B2 | 7/2013 | Quesada | |
| D689,360 | S | 9/2013 | Adams | |
| D690,592 | S | 10/2013 | Ding | |
| D690,593 | S | 10/2013 | Kaps et al. | |
| D694,099 | S | 11/2013 | Ensslen, III et al. | |
| D699,563 | S | 2/2014 | McAdam | |
| 8,707,475 | B2 | 4/2014 | Johnson et al. | |
| D706,626 | S | 6/2014 | Lazar | |
| D709,363 | S | 7/2014 | Boehnen et al. | |
| 8,789,899 | B2 | 7/2014 | Pirro et al. | |
| D710,713 | S | 8/2014 | Fath | |
| 8,915,381 | B2 | 12/2014 | Brozak et al. | |
| D729,055 | S | 5/2015 | Lemnios et al. | |
| 2001/0002660 | A1 | 6/2001 | Riga et al. | |
| 2001/0054258 | A1 | 12/2001 | Becken | |
| 2002/0134030 | A1 | 9/2002 | Conway | |
| 2002/0144375 | A1 | 10/2002 | Drucker et al. | |
| 2002/0157318 | A1 | 10/2002 | Teubert et al. | |
| 2003/0019982 | A1 | 1/2003 | Wing et al. | |
| 2003/0047528 | A1 | 3/2003 | Stein | |
| 2004/0159049 | A1 | 8/2004 | Teubert et al. | |
| 2004/0177437 | A1 | 9/2004 | Perry | |
| 2004/0238465 | A1 | 12/2004 | Mercure | |
| 2004/0245195 | A1 | 12/2004 | Pride | |
| 2005/0006332 | A1 | 1/2005 | Stein | |
| 2005/0115202 | A1 | 6/2005 | Mertz, II et al. | |
| 2005/0115860 | A1 | 6/2005 | Mertz, II et al. | |
| 2005/0236299 | A1 | 10/2005 | Weber et al. | |
| 2006/0043032 | A1 | 3/2006 | McHugh | |
| 2006/0196838 | A1 | 9/2006 | Mercure et al. | |
| 2006/0208150 | A1* | 9/2006 | Elmer | E05D 15/0652 248/694 |
| 2007/0045204 | A1 | 3/2007 | Huard et al. | |
| 2007/0295680 | A1 | 12/2007 | Budge et al. | |
| 2008/0073469 | A1 | 3/2008 | Mushan et al. | |
| 2008/0148639 | A1 | 6/2008 | Jakob-Bamberg et al. | |
| 2008/0148692 | A1 | 6/2008 | Wisecarver et al. | |
| 2008/0277363 | A1 | 11/2008 | McDonough | |
| 2009/0115299 | A1 | 5/2009 | Ricereto | |
| 2010/0107497 | A1 | 5/2010 | Hulst et al. | |
| 2010/0181267 | A1 | 7/2010 | Theisen | |
| 2011/0035871 | A1 | 2/2011 | Seymour et al. | |
| 2011/0113547 | A1* | 5/2011 | O'Connell | A47K 3/38 4/608 |
| 2012/0005822 | A1 | 1/2012 | Daubmann et al. | |
| 2012/0036628 | A1* | 2/2012 | O'Connell | A47K 3/38 4/610 |
| 2012/0233926 | A1 | 9/2012 | Chang et al. | |
| 2012/0259743 | A1 | 10/2012 | Pate, Jr. | |
| 2013/0093298 | A1 | 4/2013 | Ehmke et al. | |
| 2013/0140319 | A1 | 6/2013 | Tam et al. | |
| 2013/0161276 | A1 | 6/2013 | Breeden et al. | |
| 2013/0325670 | A1 | 12/2013 | Austin, III et al. | |
| 2014/0032447 | A1 | 1/2014 | Fisher | |
| 2014/0173990 | A1 | 6/2014 | Schachter et al. | |
| 2014/0237715 | A1 | 8/2014 | Wei | |
| 2014/0250795 | A1 | 9/2014 | Wei | |
| 2014/0259363 | A1 | 9/2014 | Ball et al. | |
| 2014/0290001 | A1 | 10/2014 | Hasegawa | |
| 2014/0319988 | A1 | 10/2014 | Dietz et al. | |
| 2014/0331564 | A1 | 11/2014 | Wei | |
| 2015/0096117 | A1* | 4/2015 | Forrest | A47H 1/022 4/610 |
| 2015/0208875 | A1 | 7/2015 | Austin, III et al. | |
| 2015/0210113 | A1 | 7/2015 | Yang | |
| 2015/0210469 | A1 | 7/2015 | Lemnios et al. | |

FOREIGN PATENT DOCUMENTS

| | | | | |
|---|---|---|---|---|
| CN | 204326804 | U | 5/2015 | |
| CN | 204370961 | U | 6/2015 | |
| DE | 2149016 | | 4/1973 | |
| DE | 9306878 | U1 | 9/1993 | |
| DE | EP 1020154 | A2 * | 7/2000 | A47K 3/34 |
| DE | 202009004111 | U1 | 7/2009 | |
| EP | 2317052 | A2 | 5/2011 | |
| EP | 2774519 | A1 | 9/2014 | |
| GB | 827312 | | 2/1960 | |
| JP | 2001095657 | A | 4/2001 | |
| JP | 2003237846 | A | 8/2003 | |
| WO | 2005035396 | A2 | 4/2005 | |
| WO | 2005035396 | A3 | 4/2005 | |
| WO | 2008076224 | A1 | 6/2008 | |
| WO | 2008133531 | A1 | 11/2008 | |
| WO | 2009029358 | A1 | 3/2009 | |

OTHER PUBLICATIONS http://www.johnsonhardware.com/doordisplay.htm, "Johnson Hardware Door Panel Display Unit", Dec. 16, 2010, 2 pages.

Quality Craft, "Installation Manual Shower Unit", Model No. 961WUX006WHI, Mar. 9, 2011, 14 pages.

U.S. Appl. No. 14/656,848, entitled "Article Divider Assembly", filed Mar. 13, 2015, 19 pages.

Design U.S. Appl. No. 29/480,730, entitled "Packaging Castors", filed Jan. 29, 2014, 3 pages.

Design U.S. Appl. No. 29/480,731, entitled "Handle for Door Packaging", filed Jan. 29, 2014, 7 pages.

Design U.S. Appl. No. 29/491,474, entitled "Handle Packaging", filed May 21, 2014, 4 pages.

Design U.S. Appl. No. 29/491,473, entitled "Handle Packaging", filed May 21, 2014, 4 pages.

Design U.S. Appl. No. 29/480,761, entitled "Shower Door Display", filed Jan. 29, 2014, 14 pages.

Design U.S. Appl. No. 29/480,762, entitled "Shower Door Display", filed Jan. 29, 2014, 16 pages.

European Search Report for corresponding Application No. 16179805.3, dated Dec. 9, 2016, 9 pages.

* cited by examiner 36
64

66
38
66
86

61
62
60
90
61
76

60
42
40
58

56
56

SHOWER DOOR GUIDE ASSEMBLY

TECHNICAL FIELD

Various embodiments relate to shower door guide assemblies.

BACKGROUND

Bypassing glass panels for prior art shower doors are often hung from a supporting cross member within a shower or tub environment. The positioning and support for this crossbeam can be achieved through a variety of methods. In some existing designs, the crossbeam is both positioned and supported at its ends by vertically aligned side supports which are attached to the vertical walls of the bath enclosure, typically a plastic tub surround or ceramic tile. In other existing designs, the crossbeam is both positioned and supported at its ends by cleats which are independently positioned and secured to the vertical walls of the bath enclosure. The crossbeam then hangs on these cleats and is often secured in place through screws which either penetrate or press against the cleat fixtures. In other existing designs, the crossbeam is supported at its ends by collars which are independently positioned and secured to the vertical walls of the bath enclosure. In these designs, the crossbeam is contained within the collars, which are inserted onto the crossbeam prior to attaching these units to the vertical walls.

SUMMARY

According to at least one embodiment, a shower door guide assembly is provided with a pair of spaced apart brackets. Each bracket is adapted to be mounted to a support surface. Each bracket has a receptacle formed therein. A crossbeam is provided with a guide formed therein for cooperation with a roller assembly of a door. The crossbeam has a cross-section sized so that terminal ends of the crossbeam are each received in one the receptacles of the pair of brackets for pivoting about a lengthwise axis of crossbeam and translation in the receptacle during installation of the crossbeam terminal ends into receptacles of the pair of brackets.

According to at least another embodiment, a shower door assembly is provided with a shower door guide assembly with a pair of spaced apart brackets. Each bracket is adapted to be mounted to a support surface. Each bracket has a receptacle formed therein. A crossbeam is provided with a guide formed therein for cooperation with a roller assembly of a door. The crossbeam has a cross-section sized so that terminal ends of the crossbeam are each received in one the receptacles of the pair of brackets for pivoting about a lengthwise axis of crossbeam and translation in the receptacle during installation of the crossbeam terminal ends into receptacles of the pair of brackets. At least one shower door is provided. A roller assembly is mounted to the at least one shower door for cooperation with the guide of the crossbeam.

According to another embodiment, a shower assembly is provided with a shower unit. A shower door assembly is provided with a shower door guide assembly with a pair of spaced apart brackets. Each bracket is adapted to be mounted to a support surface of the shower unit. Each bracket has a receptacle formed therein. A crossbeam is provided with a guide formed therein for cooperation with a roller assembly of a door. The crossbeam has a cross-section sized so that terminal ends of the crossbeam are each received in one the receptacles of the pair of brackets for pivoting about a lengthwise axis of crossbeam and translation in the receptacle during installation of the crossbeam terminal ends into receptacles of the pair of brackets. At least one shower door is provided. A roller assembly is mounted to the at least one shower door for cooperation with the guide of the crossbeam.

A method of installing a shower door guide assembly includes providing a shower door guide assembly with a pair of spaced apart brackets that are adapted to be mounted to a support surface. Each bracket has a receptacle formed therein. A crossbeam is provided with a guide formed therein for cooperation with a roller assembly of a door. The crossbeam has a cross-section sized so that terminal ends of the crossbeam are each received in one the receptacles of the pair of brackets for pivoting about a lengthwise axis of crossbeam and translation in the receptacle during installation of the crossbeam terminal ends into receptacles of the pair of brackets. The pair of brackets is installed to the support surfaces. The terminal ends of the crossbeam are inserted into the receptacles. The crossbeam is translated while pivoted into the receptacles.

According to at least another embodiment, a shower door guide assembly is provided with a pair of spaced apart brackets. Each bracket is adapted to be mounted to a support surface. Each bracket has a receptacle formed therein. A crossbeam is provided with a guide formed therein for cooperation with a roller assembly of a door. The crossbeam has a cross-section sized so that terminal ends of the crossbeam are each received in one the receptacles of the pair of brackets. The receptacles and the crossbeam are sized so that each terminal end of the crossbeam can be received in only one receptacle at only one orientation of the installed crossbeam to prevent improper installation.

According to at least another embodiment, a shower door guide assembly is provided with a pair of wall jambs each adapted to be mounted to a support surface. A pair of spaced apart brackets is adapted to be mounted to the support surfaces. Each bracket has a receptacle formed therein. An alignment configuration extends from each bracket to engage one of the pair of wall jambs for alignment of the pair of brackets relative to the pair of wall jambs. A crossbeam has a guide formed therein for cooperation with a roller assembly of a door. The crossbeam has a cross-section sized so that terminal ends of the crossbeam are each received in one the receptacles of the pair of brackets.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
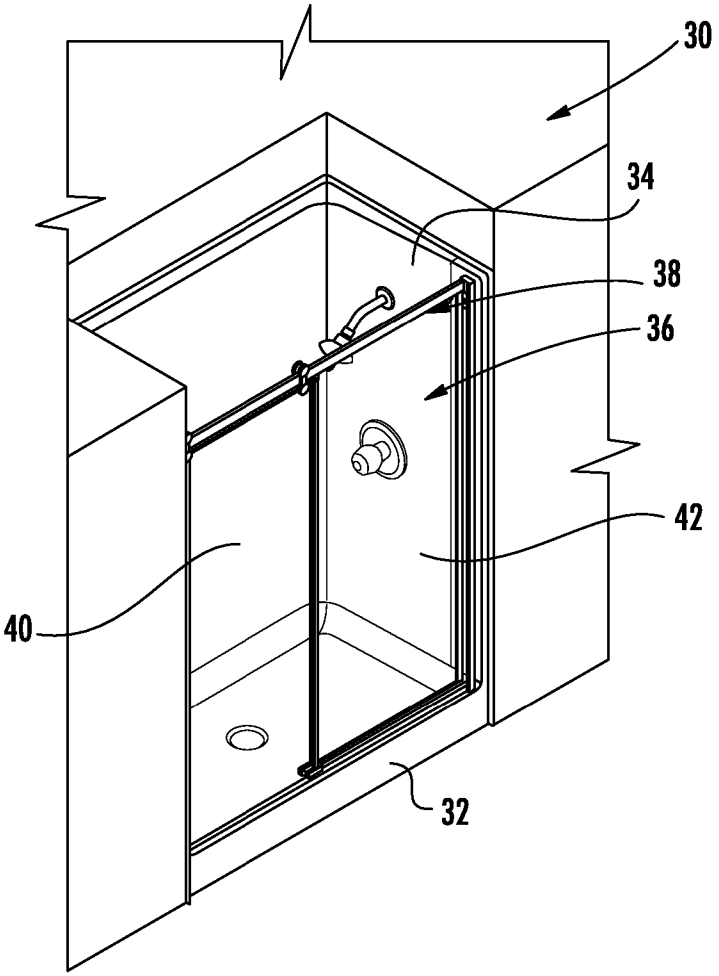
FIG. 1 is a perspective view of a shower assembly according to an embodiment, illustrated utilizing a shower door guide assembly according to another embodiment.

With reference now to FIG. 1, a shower assembly is illustrated and reference generally by numeral 30. The shower assembly 30 includes a shower tray 32 and a shower surround unit 34 that collectively define a shower space. A shower door assembly 36 encloses one side of the shower space by cooperating with the shower tray 32 and the shower surround unit 34. The shower door assembly 36 includes a shower door guide assembly 38 for supporting a pair of bypassing shower doors 40, 42 for sliding along the shower door guide assembly 38 for opening and closing an entrance to the shower space.

Figure 2:
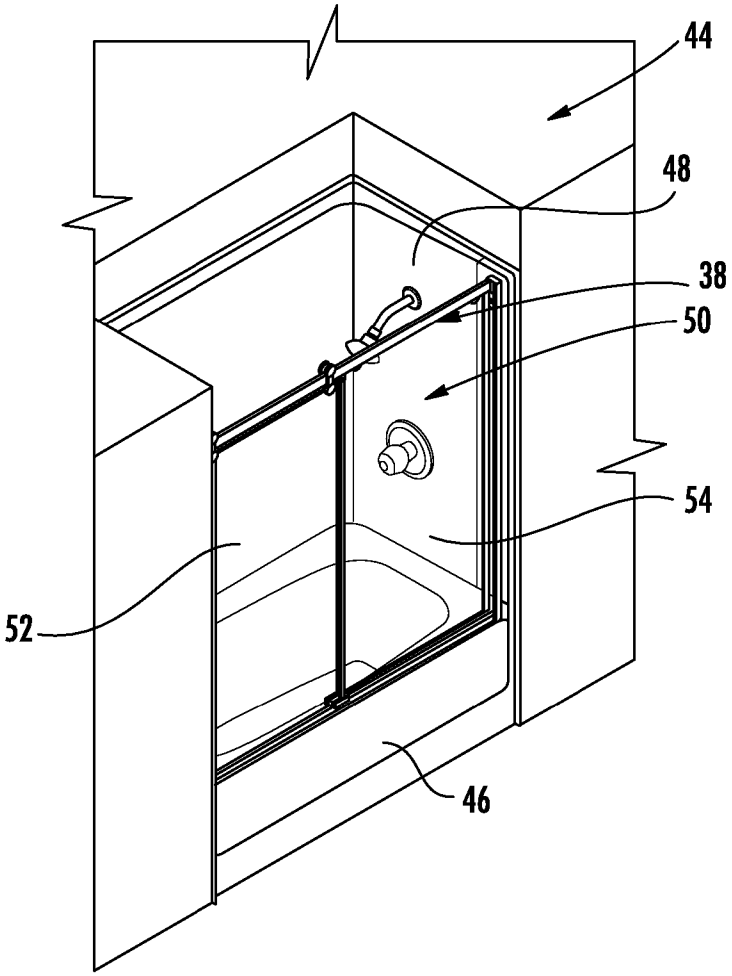
FIG. 2 is a perspective view of a shower assembly according to another embodiment, illustrated utilizing the shower door guide assembly of FIG. 1.

FIG. 2 illustrates another shower assembly 44 according to another embodiment, with a bathtub 46 and a bathtub shower surround unit 48. A shower door assembly 50 is provided similar to the prior embodiment. The shower door assembly 50 includes the shower door guide assembly 38 with a pair of shower doors 52, 54 that are sized to engage the bathtub 46 and bathtub shower surround unit 48.

Figures 3, 4, 5, 6, 7:
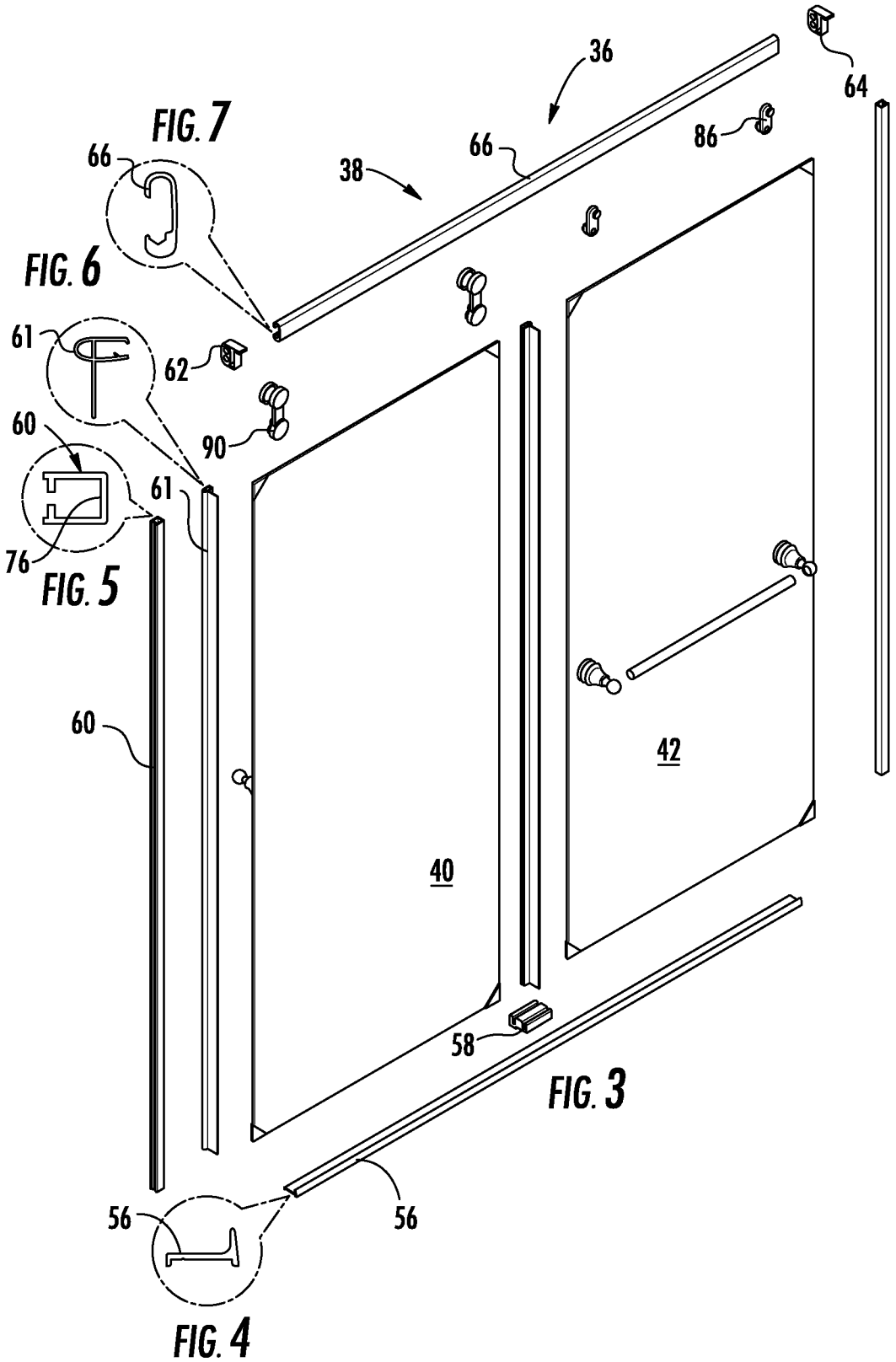
FIG. 3 is an exploded view of a shower door assembly of FIG. 1, including the shower door guide assembly.
FIG. 4 is an axial end view of a bottom track of the shower door assembly of FIG. 1.
FIG. 5 is an axial end view of a wall jamb of the shower door assembly of FIG. 1.
FIG. 6 is an axial end view of a seal of the shower door assembly of FIG. 1.
FIG. 7 is an axial end view of a crossbeam of the shower door assembly of FIG. 1.

FIG. 3 illustrates the shower door assembly 36 exploded for illustration of various components. A bottom track rail 56 (FIGS. 3 and 4) is mounted to the shower tray 32. A bottom track guide 58 is mounted to the bottom track rail 56 for lower guidance of the shower doors 40, 42. A pair of wall jambs 60 (FIGS. 3 and 5) are fastened to the shower surround unit 34. A pair of seals 61 (FIGS. 3 and 6) are provided for the shower door 40.

FIG. 3 depicts that the shower door guide assembly 38 includes a pair of brackets 62, 64 for supporting a crossbeam 66 (FIGS. 3 and 7) upon which the glass panel shower doors 40, 42 are hung and supported. As will be explained, the geometric interactions of these system components are designed to provide a method of positioning and securing the crossbeam 66 creating a convenient user experience when installing the shower doors 40, 42. In comparison to the prior art, the shower door guide assembly 38 permits the user to support and secure the crossbeam 66 utilizing an open cleat design which provides the user secure locations to place the crossbeam 66 into pre-positioned brackets 62, 64.

Figure 8:
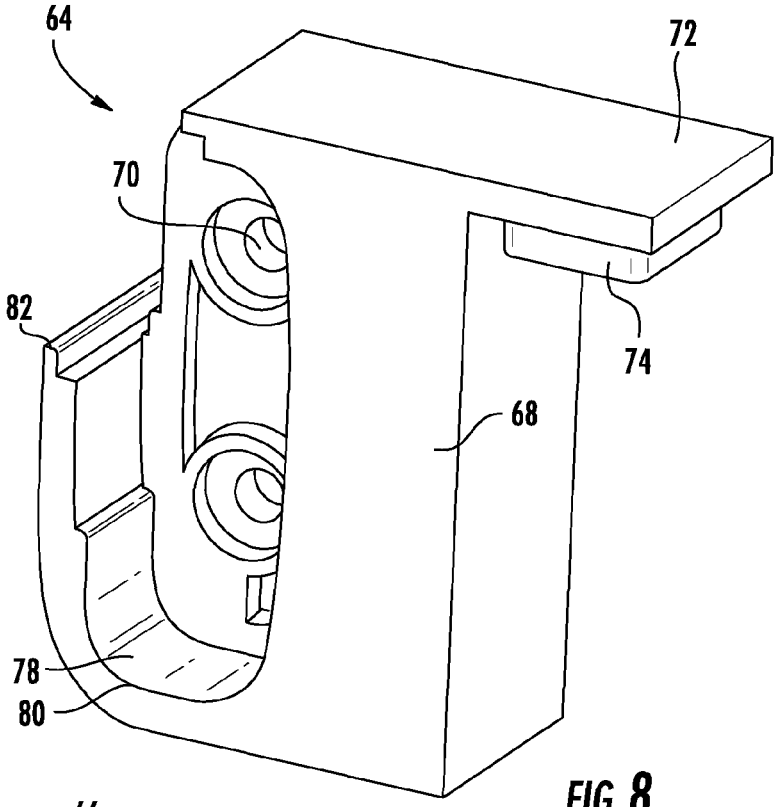
FIG. 8 is a perspective view of a bracket of the shower door assembly of FIG. 1.

FIG. 8 illustrates one of the brackets 64 enlarged and in greater detail. Although only one bracket 64 is depicted in FIG. 8, the other bracket 62 is similar and a mirror image of the depicted bracket 64 for cooperating with an opposite terminal end of the crossbeam 66. The bracket 64 includes a body 68 with a pair of counter-bored apertures 70 for receiving fasteners to fasten the bracket 64 directly to a support surface, such as sidewall of the shower surround unit 34, a bathtub shower surround unit 48, a ceramic-tiled wall or any suitable support surface in a shower unit. Likewise, the other bracket 62 is mounted to a parallel vertical support surface. By fastening the brackets 62, 64 directly to support surfaces, the brackets 62, 64 support the load of the shower door guide assembly 38 and the shower doors 40, 42 without distributing the load to the wall jambs 60 as is common in the prior art.

With continued reference to FIG. 8, the bracket 64 includes an alignment extension 72 extending from the body 68 with a pilot 74 projecting downward from the extension. The pilot 74 is sized to be received in a cavity 76 formed in the wall jambs 60 as illustrated in FIG. 5. The cooperation of the brackets 62, 64 with the wall jambs 60 does not distribute the load of the shower door guide assembly 38 and shower doors 40, 42 due to the fastened connection of the body 68 to the support surface. The cooperation of the brackets 62, 64 with the wall jambs 60 provides alignment for installation of the brackets 62, 64. This alignment prevents separate measurement for the locations of the brackets 62, 64, which may result in misalignment and inconveniences associated with prior art systems while improving structural integrity over the prior art systems.

As illustrated in FIG. 8, the bracket 64 includes a receptacle 78 formed therein with an opening 80 for receipt of one of the terminal ends of the crossbeam 66. Both brackets 62, 64 are installed with corresponding openings 80 of the receptacles 78 facing each other for collectively receiving and supporting both terminal ends of the crossbeam 66 in the receptacles 78. The mounting apertures 70 are conveniently located with counterbores in the receptacle 78 for concealment by the crossbeam 66 upon installation of the crossbeam 66. In other words, the receptacles 78 of the brackets 62, 64 are aligned in a lengthwise direction of the crossbeam 66.

The bracket 64 also includes an ingress opening 82 formed into the body 68 generally perpendicular to a lengthwise direction of the crossbeam. The ingress opening 82 intersects the receptacle 78 and the receptacle opening 80 to permit the crossbeam 66 to pass into the receptacle 78 after the brackets 62, 64 are installed.

Figure 9:
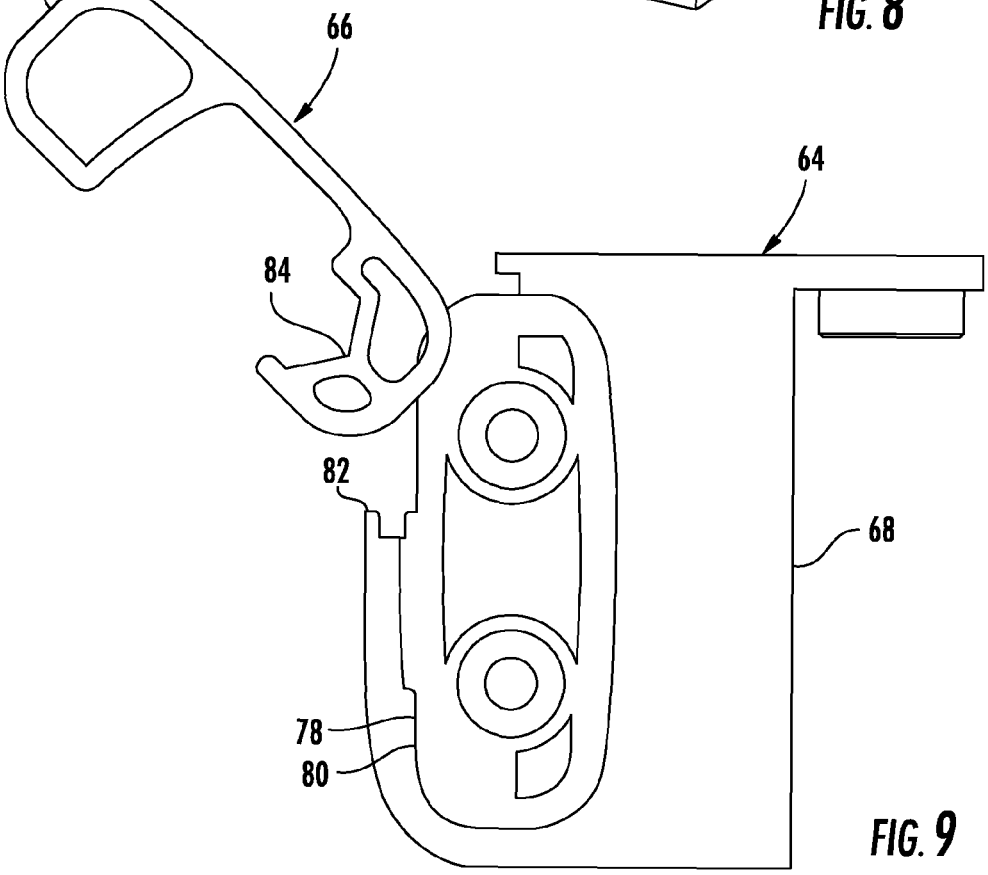
FIG. 9 is a side elevation view of the bracket of FIG. 8, illustrated with the crossbeam of FIG. 7 in an assembly position.

FIG. 9 illustrates the bracket 64 with the introduction of the crossbeam 66 for installation into the brackets 62, 64. The crossbeam 66 has a generally consistent cross-section along its length for cooperation with both brackets 62, 64. The crossbeam 66 includes at least one guide formed therein. For the bypassing shower doors 40, 42 of the described embodiment, the crossbeam 66 includes a pair of guides. For example, a concave guide or track 84 is formed in the crossbeam 66 for receipt of a lower roller assembly 86 of the shower door 42. (The lower roller assembly 86 is illustrated in FIG. 3). By way of another example a convex guide or rail 88 is provided on an upper end of the crossbeam 66 to support an upper concave roller assembly 90 of the shower door 40. (The upper roller assembly 90 is also illustrated in FIG. 3).

Figure 10:
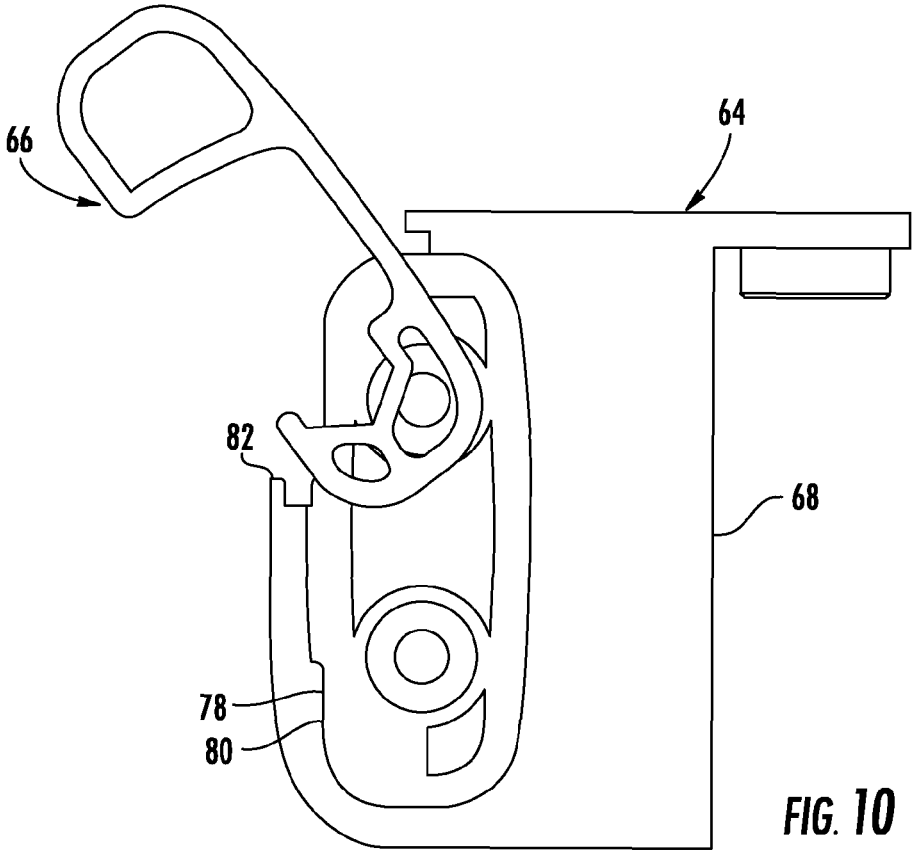
FIG. 10 is another side elevation view of the bracket and crossbeam of FIG. 9, illustrated in another assembly position.
Figure 11:
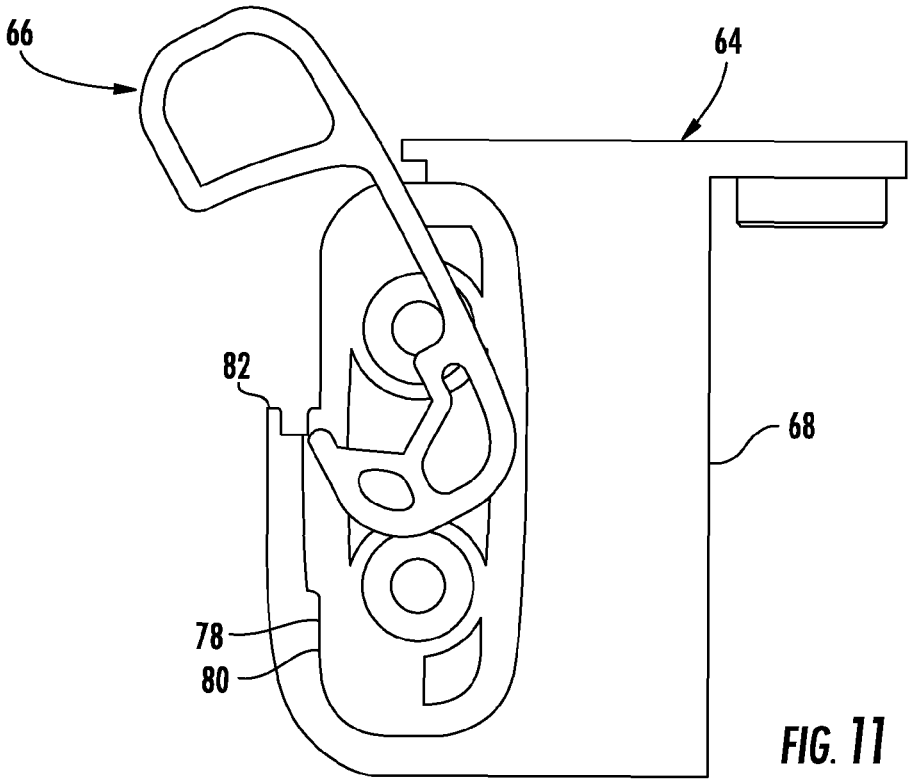
FIG. 11 is another side elevation view of the bracket and crossbeam of FIG. 9, illustrated in another assembly position.
Figure 12:
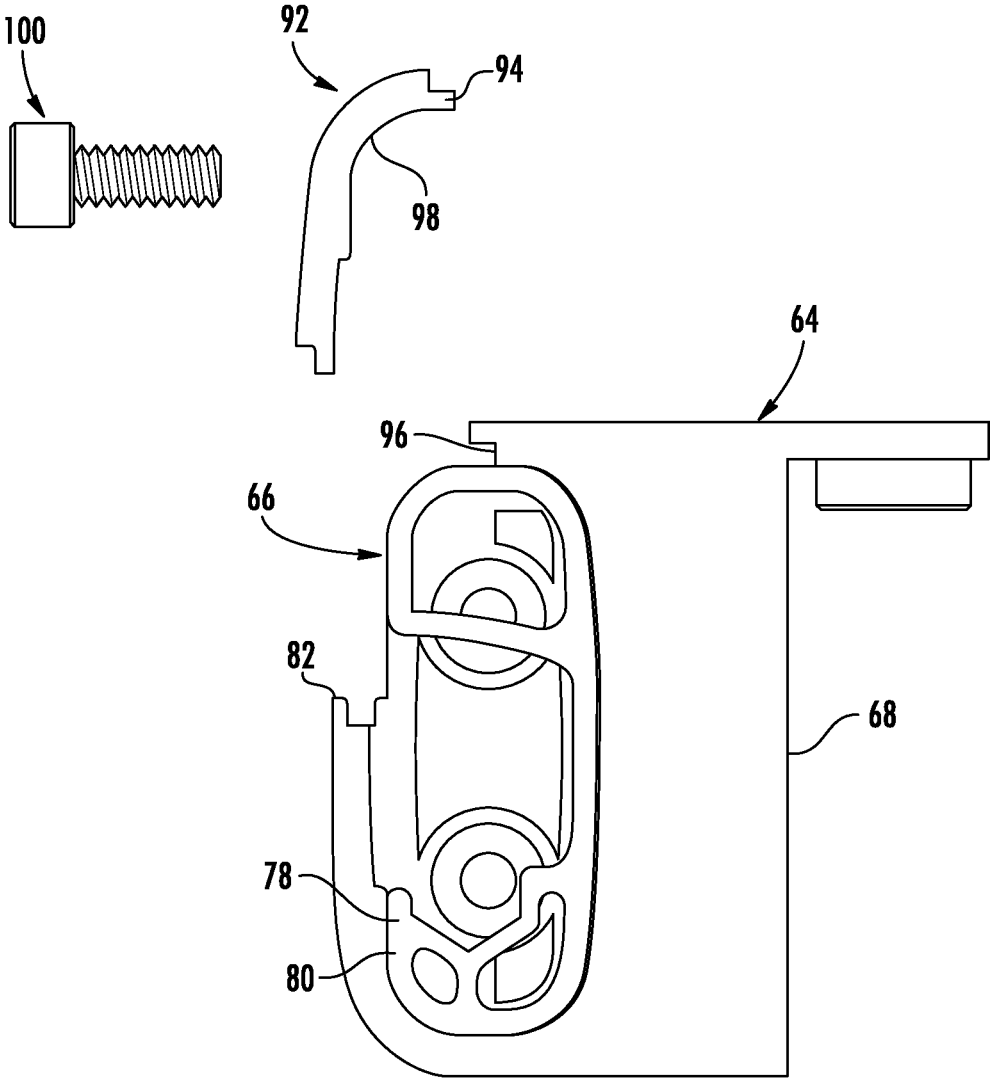
FIG. 12 is another side elevation view of the bracket and crossbeam of FIG. 9, illustrated in an assembled position with a retainer and a fastener.
Figure 13:
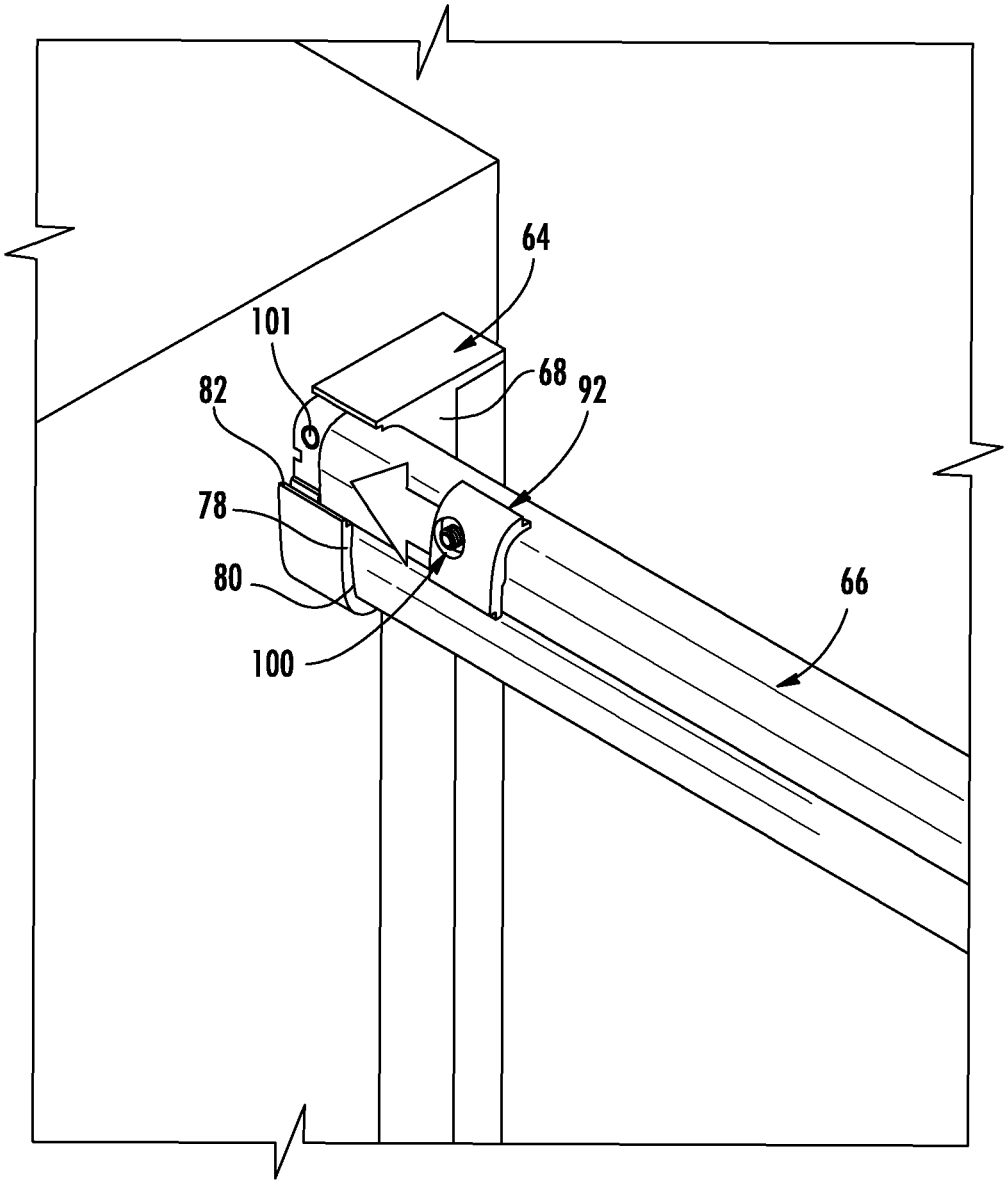
FIG. 13 is a perspective view of the bracket, crossbeam, retainer and fastener of FIG. 12.

The crossbeam 66 is illustrated partially pivoted in FIG. 9 about a lengthwise axis for alignment with the ingress opening 82. FIG. 10 illustrates the lower end of the crossbeam 66 further translated for insertion through the ingress opening 82 into the receptacle 78. FIG. 11 illustrates the lower end of the crossbeam 66 further translated into the receptacle 78 as the crossbeam is pivoted partially towards vertical for alignment in the receptacle 78 and further translation through the ingress opening 82. FIGS. 12 and 13 illustrate the crossbeam 66 fully translated into the receptacle 78. At this orientation, the crossbeam 66 is pivoted to an upright orientation.

FIGS. 12 and 13 also illustrate a retainer 92 that is shaped to match an outer profile of the bracket body 68. The retainer 92 includes a pair of keys 94 oriented in the lengthwise direction of the crossbeam 66. Likewise a pair of keyways 96 is formed in the bracket body 68 at the ingress opening 82. The retainer 92 includes an inner profile 98 that is formed consistent with the receptacle 78. As illustrated in FIGS. 12 and 13, the retainer keys 94 are inserted into the keyways 96 to enclose and block the egress opening 82 to retain the crossbeam 66 in the receptacle 78 to prevent inadvertent disassembly. A fastener 100 is installed into the retainer 92 in engagement with an aperture 101 in the bracket body 68 to secure the retainer 92 in the installed position of FIG. 14. Additionally, the assembly steps can be reversed for disassembly of the shower door assembly 36.

Figure 14:
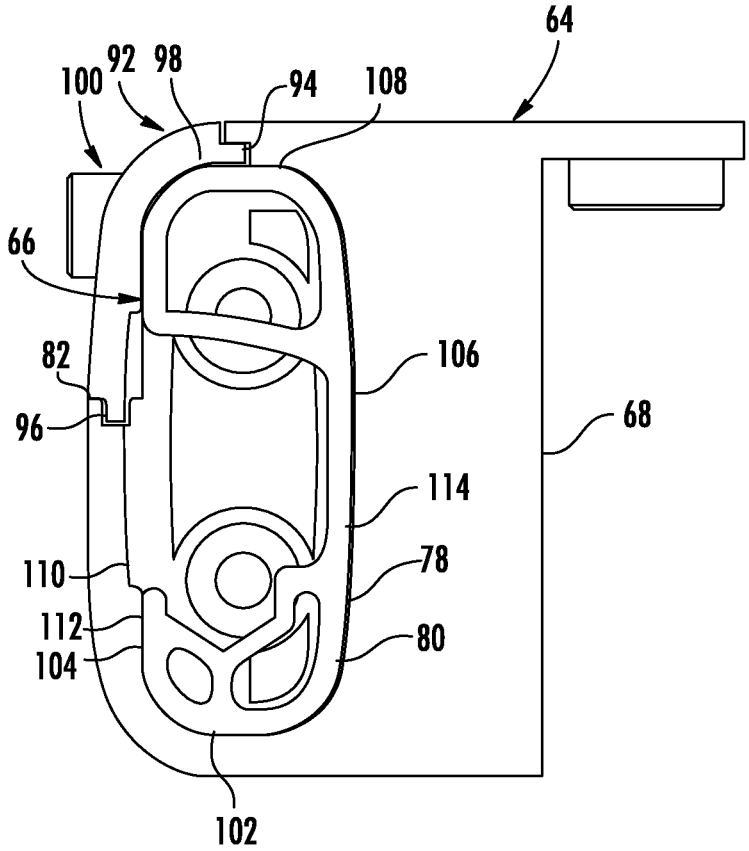
FIG. 14 is a side elevation view of the bracket, crossbeam, retainer and fastener of FIG. 12, illustrated in a fastened position.

With continued reference to FIG. 14, the receptacle 78 includes a lower contact region 102, a pair of lateral side contact regions 104, 106, and an upper contact region 108 for contacting the installed crossbeam 66. A clearance region 110 is also provided to permit clearance for pivoting and translation of the crossbeam during installation and disassembly. The ingress opening 82 is formed through the upper contact region 108 and the lateral side contact region 104 thereby prescribing the pivoting while translating installation of crossbeam 66. This arrangement does not permit a vertical drop-in of the crossbeam 66 as in the prior art. The pivoted and translated installation requires an abnormal application of motion in order to disassemble the crossbeam 66. Additionally, by retaining the crossbeam 66 with the upper contact region 108, the crossbeam 66 is retained by the bracket 64 and then locked by the retainer 92.

Once the shower doors 40, 42 are installed to the crossbeam 66, a load is applied to crossbeam 66 between the brackets 62, 64. This loading causes a downward deflection upon the center of the crossbeam 66 with a resultant upward deflection at the terminal ends of the crossbeam 66. The resultant upward deflection is constrained by the upper contact region 108. By minimizing deflection at the terminal ends, the causal deflection along the length of the crossbeam 66 is also minimized.

According to one embodiment, the receptacles 78 and the crossbeam 66 are sized and shaped so that each terminal end of the crossbeam 66 can be received in only one receptacle 78 of the brackets 62, 64. This feature prevents improper installation of the crossbeam 66 into the brackets 62, 64.

In order to prevent improper installation of the crossbeam 66, the lateral side regions 104, 106 of the receptacle 78 are formed with different shapes. For example, the lateral side region 104 adjacent the ingress opening 82 is generally flat, while the other lateral side region 106 is generally curved. The crossbeam 66 includes a pair of corresponding contact surfaces 112, 114, which are formed flat and curved respectively to mate with the corresponding receptacle regions 104, 106.

Figure 15:
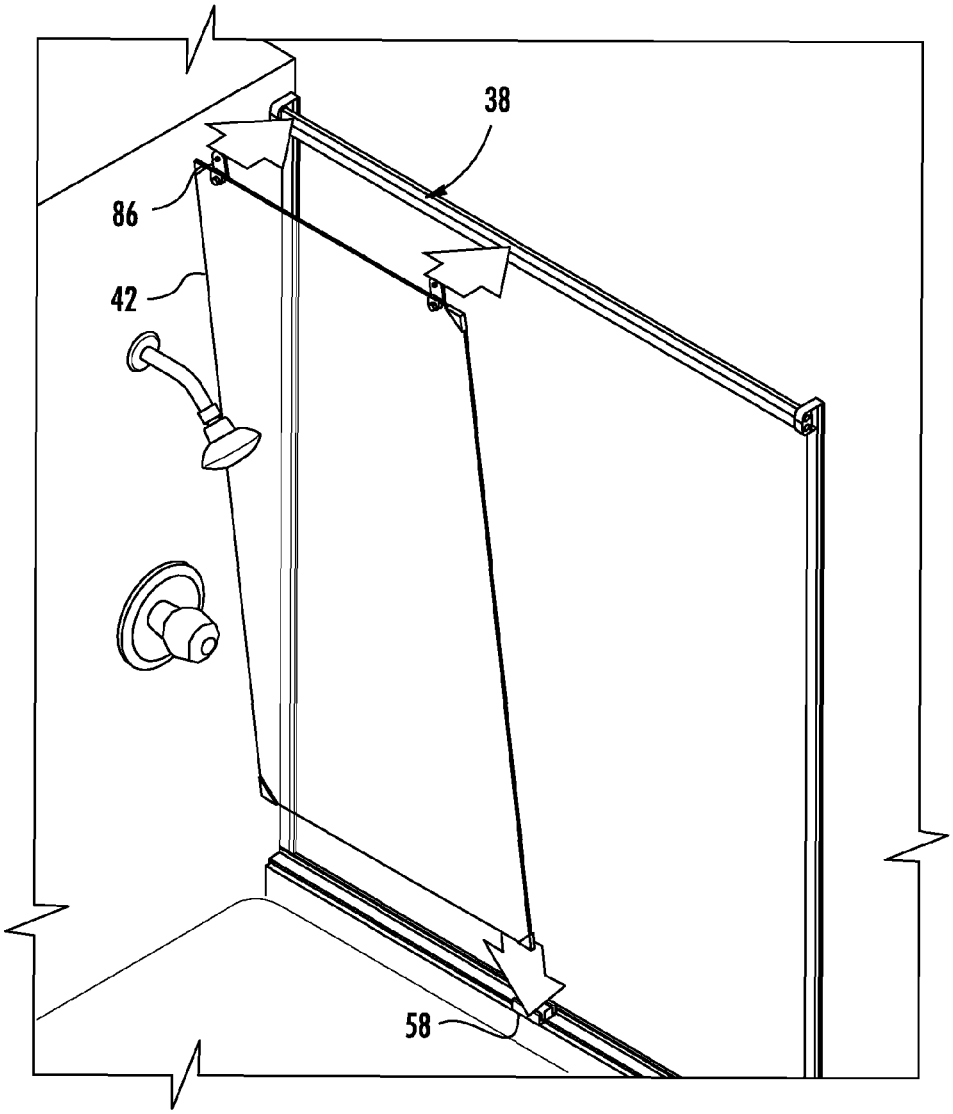
FIG. 15 is a perspective view of the shower assembly of FIG. 1, illustrated in an assembly position.
Figure 16:
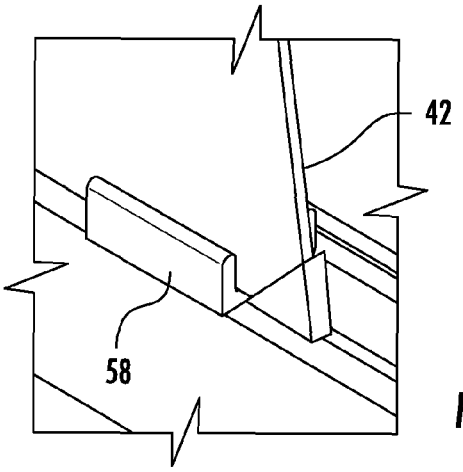
FIG. 16 is another perspective view of the shower assembly of FIG. 1, illustrated in another assembly position.
Figure 17:
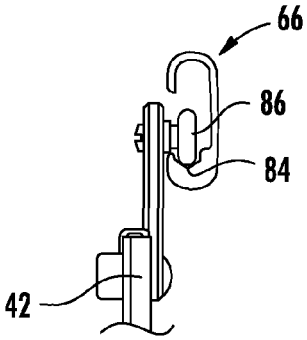
FIG. 17 is a side elevation view of the shower door assembly of FIG. 3, illustrated partially assembled.

FIGS. 15-17 illustrate the installation of the shower door 42 to the shower door guide assembly 38. The shower door 42 is inserted into the bottom track guide 58. Then the lower roller assembly 86 is inserted into the track 84 of the crossbeam 66.

Figure 18:
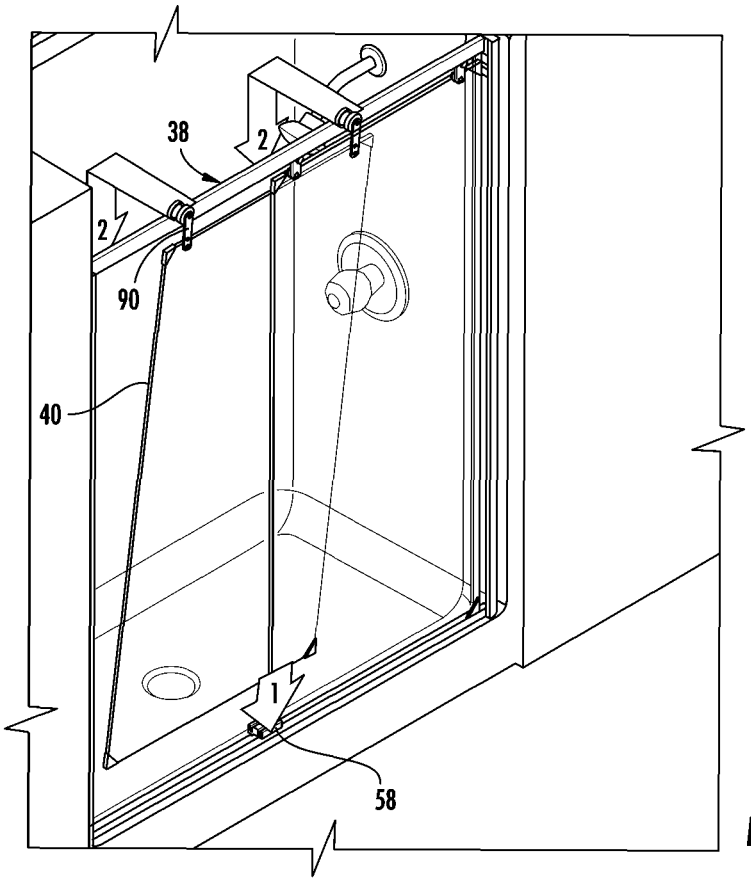
FIG. 18 is another perspective view of the shower assembly of FIG. 1, illustrated in another assembly position.
Figure 19:
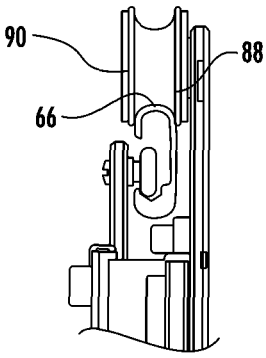
FIG. 19 is a side elevation view of the shower door assembly of FIG. 3.

FIGS. 18 and 19 illustrate the installation of the shower door 40 to the shower door guide assembly 38. The shower door 40 is inserted into the bottom track guide 58. Then the upper roller assembly 90 is placed upon the rail 88 of the crossbeam 66.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A shower door guide assembly comprising:

a pair of spaced apart brackets, each bracket being adapted to be mounted to a support surface, and each bracket having a receptacle formed therein; and a crossbeam with a guide formed therein for cooperation with a roller assembly of a door, the crossbeam having a cross-section sized so that terminal ends of the crossbeam are each received in one of the receptacles of the pair of brackets for pivoting about a lengthwise axis of the crossbeam and translation in the receptacle during installation of the crossbeam terminal ends into the receptacles of the pair of brackets;

wherein a vertical drop-in of the crossbeam is not permitted;

wherein the receptacles are each formed into the corresponding bracket in a lengthwise direction of the crossbeam with a receptacle opening in the bracket adjacent the receptacle for extension of the crossbeam from the bracket;

wherein an ingress opening is formed in at least one of the brackets intersecting the receptacle and the receptacle opening for installation of the crossbeam terminal end into the receptacle;

wherein the ingress opening is formed generally normal to the lengthwise direction;

wherein each receptacle is provided with a lower contact region, and a pair of lateral side contact regions;

wherein the ingress opening is formed through one of the pair of lateral side contact regions; and wherein said one lateral side contact region is of a height less than the other lateral side contact region.

2. The shower door guide assembly of claim 1 wherein the crossbeam has a generally consistent cross-section along its length.

3. The shower door guide assembly of claim 1 further comprising a retainer sized to fasten to the bracket to at least partially block the ingress opening and retain the crossbeam in the receptacle.

4. The shower door guide assembly of claim 1 wherein each receptacle is provided with an upper contact region to constrain the terminal end of the crossbeam between the upper and lower contact regions to minimize deflection of the crossbeam.

5. The shower door guide assembly of claim 4 wherein the ingress opening is formed through the upper contact region and one of the pair of lateral side contact regions.

6. The shower door guide assembly of claim 1 wherein the receptacles and the crossbeam are sized so that each terminal end of the crossbeam can be received in only one receptacle at only one orientation of the installed crossbeam to prevent improper installation.

7. The shower door guide assembly of claim 1 further comprising:

a pair of wall jambs each adapted to be mounted to one of the support surfaces; and an alignment configuration extending from each bracket to engage one of the pair of wall jambs for alignment of the pair of brackets relative to the pair of wall jambs.

8. The shower door guide assembly of claim 1 wherein the guide is formed in a lateral side of the crossbeam.

9. The shower door guide assembly of claim 1 wherein the ingress opening is formed through only one of the pair of lateral side contact regions.

10. A shower door assembly comprising:

a shower door guide assembly according to claim 1;

at least one shower door; and a roller assembly mounted to the at least one shower door for cooperation with the guide of the crossbeam.

11. A shower assembly comprising:

a shower unit with support surfaces; and a shower door assembly according to claim 10.

12. A method of installing a shower door guide assembly comprising the steps of:

providing a shower door guide assembly according to claim 1;

installing the pair of brackets to the support surfaces;

inserting the terminal ends of the crossbeam into the receptacles; and translating while pivoting the crossbeam into the receptacles.

13. The shower door guide assembly of claim 1 wherein the pair of lateral side contact regions is provided with different shaped contact surfaces.

14. The shower door guide assembly of claim 13 wherein the crossbeam has a pair of external lateral side contact surfaces that are each sized to be received by only one of the pair of lateral side contact regions of the at least one receptacle.

15. The shower door guide assembly of claim 14 wherein one of the pair of lateral side contact regions of the at least one receptacle is generally flat; and wherein another of the pair of lateral side contact regions of the at least one receptacle is generally curved.

16. The shower door guide assembly of claim 15 wherein one of the pair of external lateral contact surfaces of the crossbeam is generally flat; and wherein another of the pair of external lateral contact surfaces of the crossbeam is generally curved.

17. A shower door guide assembly comprising:

a pair of spaced apart brackets, each bracket being adapted to be mounted to a support surface, and each bracket having a receptacle formed therein; and a crossbeam with a guide formed therein for cooperation with a roller assembly of a door, the crossbeam having a cross-section sized so that terminal ends of the crossbeam are each received in one of the receptacles of the pair of brackets for pivoting about a lengthwise axis of the crossbeam and translation in the receptacle during installation of the crossbeam terminal ends into the receptacles of the pair of brackets;

wherein a vertical drop-in of the crossbeam is not permitted;

wherein the receptacles are each formed into the corresponding bracket in a lengthwise direction of the crossbeam with a receptacle opening in the bracket adjacent the receptacle for extension of the crossbeam from the bracket;

wherein an ingress opening is formed in at least one of the brackets intersecting the receptacle and the receptacle opening for installation of the crossbeam terminal end into the receptacle;

wherein each receptacle is provided with a lower contact region, and a pair of lateral side contact regions; and wherein the ingress opening is formed through one of the pair of lateral side contact regions; and wherein said one lateral side contact region is of a height less than the other lateral side contact region.

* * * * *